US010898948B2

(12) United States Patent
Wang et al.

(10) Patent No.: US 10,898,948 B2
(45) Date of Patent: Jan. 26, 2021

(54) METHOD OF MANUFACTURING METAL CASTINGS

(71) Applicant: GM Global Technology Operations LLC, Detroit, MI (US)

(72) Inventors: Qigui Wang, Rochester Hills, MI (US); Christopher D. Cogan, Clarkston, MI (US); Michael J. Walker, Shelby Township, MI (US); Garrold DeGrace, Frankenmuth, MI (US); Thomas Gustafson, Clarkston, MI (US); Dale Gerard, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 39 days.

(21) Appl. No.: 16/376,667

(22) Filed: Apr. 5, 2019

(65) Prior Publication Data

US 2020/0316676 A1 Oct. 8, 2020

(51) Int. Cl.
*B22C 9/02* (2006.01)
*B22D 29/00* (2006.01)

(52) U.S. Cl.
CPC ..... *B22C 9/02* (2013.01); *B22D 29/00* (2013.01)

(58) Field of Classification Search
CPC .... B22C 9/02; B22C 9/08; B22C 9/10; B22C 9/24; B22D 15/02; B22D 21/00; B22D 21/007; B22D 29/00
USPC ..... 164/47, 122, 133, 136, 137
See application file for complete search history.

(56) References Cited

U.S. PATENT DOCUMENTS

| | | | | |
|---|---|---|---|---|
| 4,733,714 | A * | 3/1988 | Smith | B22D 27/08 164/130 |
| 5,215,141 | A * | 6/1993 | Kuhn et al. | B22D 18/04 164/133 |
| 2018/0016666 | A1 * | 1/2018 | Cogan et al. | B22D 15/02 |

OTHER PUBLICATIONS

Cogan,Christopher D.; Wang,Qigui; Meyer, Maurice G. Unpublished U.S. Appl. No. 15/212,905, filed Jul. 18, 2016.
Walker, Michael J.; Wang,Qigui,; Carter,Jon T., Unpublished U.S. Appl. No. 15/804,315, filed Nov. 6, 2017.

* cited by examiner

*Primary Examiner* — Kevin P Kerns

(57) ABSTRACT

A method of manufacturing an aluminum alloy cylinder head includes providing a precision sand core and mold assembly, a liquid aluminum alloy delivery system, and a mold manipulator system. The precision sand core and mold assembly is disposed in the mold manipulator system and the liquid aluminum alloy delivery system includes an in-furnace ultrasonic actuator and a launder tube having at least an ultrasonic actuator. The liquid aluminum alloy delivery system is sealed to the precision sand core and mold assembly and provides liquid aluminum alloy into a gating system of the precision sand core and mold assembly. The precision sand core and mold assembly is rotated approximately 180°. The precision sand core and mold assembly is vibrated.

15 Claims, 7 Drawing Sheets

METHOD OF MANUFACTURING METAL CASTINGS

INTRODUCTION

The present disclosure relates to metal casting processes and more particularly to aluminum alloy casting processes.

Many different casting processes currently produce high performance aluminum alloy cylinder heads. Low pressure permanent and semi-permanent mold cast processes use sand cores for internal passages and features. However, these processes tend to produce castings having low mechanical properties. While castings made using a process known as Rotacast®, a registered mark of Nemak, have improved mechanical properties, the process tends to have a high associated cost due to long cycle times and low yield.

Thus, some current aluminum casting processes produce less expensive castings having lower mechanical properties. Other processes produce castings with high mechanical properties at an increased cost. Accordingly, there is a need in the art for an improved casting process that produces high quality, high performance aluminum castings at a lower, more competitive cost.

SUMMARY

The present disclosure provides a method of manufacturing an aluminum alloy cylinder head. The method includes providing a precision sand core and mold assembly, a liquid aluminum alloy delivery system, and a mold manipulator system. The precision sand core and mold assembly is disposed in the mold manipulator system. Next, the liquid aluminum alloy delivery system is sealed to the precision sand core and mold assembly. The delivery system provides liquid aluminum alloy into a gating system of the precision sand core and mold assembly. The precision sand core and mold assembly is rotated approximately 180°. Then the precision sand core and mold assembly is vibrated.

In one example of the present disclosure, the method further comprises providing the precision sand core and mold assembly having a head deck face chill, a piston core, and a gate shut-off core, the liquid aluminum alloy delivery system, and the mold manipulator system. The precision sand core and mold assembly is disposed in the mold manipulator system.

In another example of the present disclosure, the method further comprises providing the precision sand core and mold assembly, the liquid aluminum alloy delivery system having an in-furnace ultrasonic actuator and a launder tube having an ultrasonic actuator, and the mold manipulator system. The precision sand core and mold assembly is disposed in the mold manipulator system.

In yet another example of the present disclosure, the method further comprises providing the precision sand core and mold assembly having a head deck face chill, a piston core, and a gate shut-off core, the liquid aluminum alloy delivery system, and the mold manipulator system having a vibration mechanism, a gate shut-off core actuator and a piston core actuator. The precision sand core and mold assembly is disposed in the mold manipulator system.

In yet another example of the present disclosure, the method further comprises providing the precision sand core and mold assembly having a head deck face chill, a piston core, and a gate shut-off core, the liquid aluminum alloy delivery system, and the mold manipulator system having a vibration mechanism, a gate shut-off core actuator and a piston core actuator. The precision sand core and mold assembly is disposed in the mold manipulator system.

In yet another example of the present disclosure, the method further comprises energizing the gate shut-off core actuator to insert the gate shut-off core into the gating system of the precision sand core and mold assembly sealing the gating system.

In yet another example of the present disclosure, the method further comprises actuating the piston core actuator to release the piston core to fall into the gating system applying pressure to the liquid aluminum alloy in the gating system.

In yet another example of the present disclosure, the method further comprises removing the head deck face chill from the precision sand core and mold assembly.

In yet another example of the present disclosure, the method further comprises quenching a head deck face of the aluminum alloy cylinder head with one of a water spray and a forced air.

The present disclosure provides another method of manufacturing an aluminum alloy cylinder head. The method includes providing a precision sand core and mold assembly, a liquid aluminum alloy delivery system, and a mold manipulator system. The precision sand core and mold assembly is disposed in the mold manipulator system. The liquid aluminum alloy delivery system includes an in-furnace ultrasonic actuator and a launder tube having at least an ultrasonic actuator. Next, the liquid aluminum alloy delivery system is sealed to the precision sand core and mold assembly. The delivery system provides liquid aluminum alloy into a gating system of the precision sand core and mold assembly. The precision sand core and mold assembly is rotated approximately 180°. Then the precision sand core and mold assembly is vibrated.

In one example of the present disclosure, the method further comprises providing the precision sand core and mold assembly having a head deck face chill, a piston core, and a gate shut-off core, the liquid aluminum alloy delivery system, and the mold manipulator system. The precision sand core and mold assembly is disposed in the mold manipulator system.

In another example of the present disclosure, the method further comprises providing the precision sand core and mold assembly, the liquid aluminum alloy delivery system having an in-furnace ultrasonic actuator and a launder tube having an ultrasonic actuator, and the mold manipulator system. The precision sand core and mold assembly is disposed in the mold manipulator system.

In yet another example of the present disclosure, the method further comprises providing the precision sand core and mold assembly having a head deck face chill, a piston core, and a gate shut-off core, the liquid aluminum alloy delivery system, and the mold manipulator system having a vibration mechanism, a gate shut-off core actuator and a piston core actuator. The precision sand core and mold assembly is disposed in the mold manipulator system.

In yet another example of the present disclosure, the method further comprises providing the precision sand core and mold assembly having a head deck face chill, a piston core, and a gate shut-off core, the liquid aluminum alloy delivery system, and the mold manipulator system. The precision sand core and mold assembly is disposed in the mold manipulator system.

In yet another example of the present disclosure, the method further comprises providing the precision sand core and mold assembly, the liquid aluminum alloy delivery system having an in-furnace ultrasonic actuator and a launder tube having an ultrasonic actuator, and the mold manipulator system. The precision sand core and mold assembly is disposed in the mold manipulator system.

In yet another example of the present disclosure, the method further comprises energizing the gate shut-off core actuator to insert the gate shut-off core into the gating system of the precision sand core and mold assembly sealing the gating system.

In yet another example of the present disclosure, the method further comprises actuating the piston core actuator to release the piston core to fall into the gating system applying pressure to the liquid aluminum alloy in the gating system.

In yet another example of the present disclosure, the method further comprises removing the head deck face chill from the precision sand core and mold assembly.

In yet another example of the present disclosure, the method further comprises quenching a head deck face of the aluminum alloy cylinder head with one of a water spray and a forced air.

The present disclosure provides another method of manufacturing an aluminum alloy cylinder head. The method comprises providing a precision sand core and mold assembly, a liquid aluminum alloy delivery system, and a mold manipulator system. The precision sand core and mold assembly is disposed in the mold manipulator system. The precision sand core and mold assembly includes a head deck face chill, a piston core, and a gate shut-off core. The liquid aluminum alloy delivery system includes an in-furnace ultrasonic actuator and a launder tube having at least an ultrasonic actuator. The mold manipulator system includes a vibration mechanism, a gate shut-off core actuator and a piston core actuator. The method also includes sealing the liquid aluminum alloy delivery system to the precision sand core and mold assembly and provide liquid aluminum alloy into a gating system of the precision sand core and mold assembly. The method also includes rotating the precision sand core and mold assembly approximately 180° about an axis of the gating system. The method further includes vibrating the precision sand core and mold assembly. The method also includes energizing the gate shut-off core actuator to insert the gate shut-off core into the gating system of the precision sand core and mold assembly sealing the gating system. The method also includes actuating the piston core actuator to release the piston core to fall into the gating system applying pressure to the liquid aluminum alloy in the gating system.

In one example of the present disclosure, the method further comprises removing the head deck face chill from the precision sand core and mold assembly.

In another example of the present disclosure, the method further comprises quenching a head deck face of the aluminum alloy cylinder head with one of a water spray and a forced air.

The above features and advantages and other features and advantages of the present disclosure are readily apparent from the following detailed description of the best modes for carrying out the disclosure when taken in connection with the accompanying drawings.

BRIEF DESCRIPTION OF THE DRAWING

The drawings described herein are for illustration purposes only and are not intended to limit the scope of the present disclosure in any way.

DESCRIPTION

Figure 1:
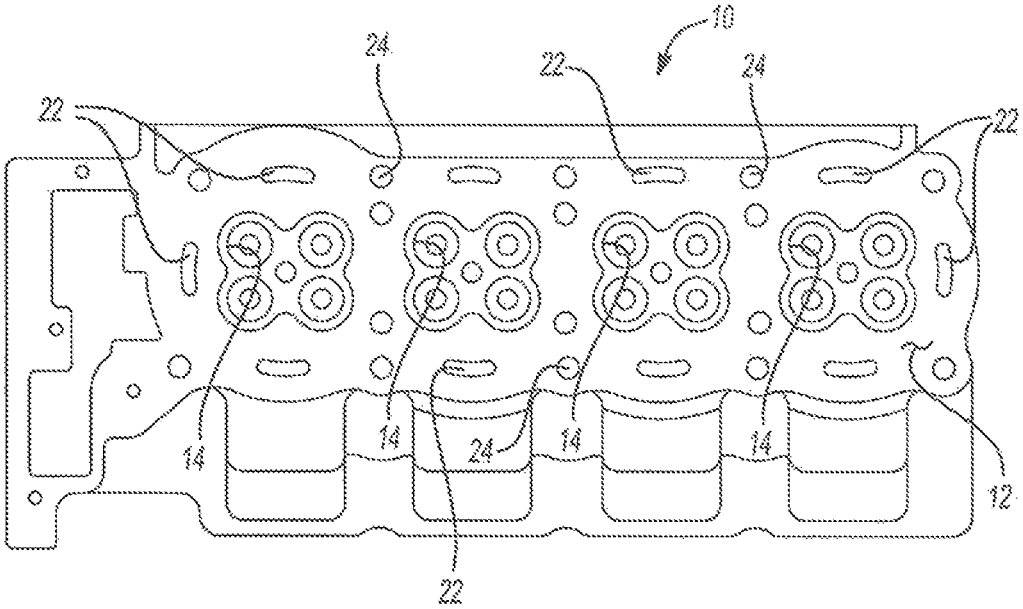
FIG. 1 is a bottom view of a cylinder head casting according to the principles of the present disclosure.
Figure 2:
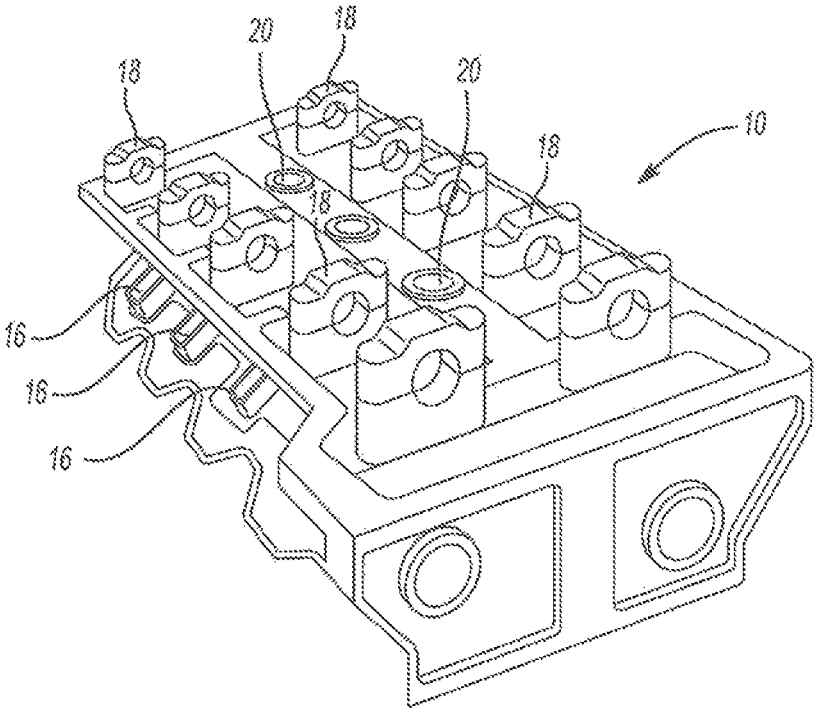
FIG. 2 is a perspective view of a cylinder head casting according to the principles of the present disclosure.

Referring to the drawings, wherein like reference numbers refer to like components, in FIGS. 1 and 2 an aluminum alloy cylinder head 10 produced using a Pressure Assist Precision Sand Casting (PAPSC) method is illustrated in accordance with an example of the present disclosure and will now be described. In general, the cylinder head 10 includes features such as a head deck 12, combustion chambers 14, intake and exhaust ports 16, camshaft bearings 18, spark plug holes 20, water jacket openings 22, and oil passages 24, among other features. More particularly, the important features of the cylinder head 10 that are at least partially formed during the casting process include the head deck 12 and combustion chambers 14. Product specifications for the head deck 12 and combustion chambers 14 generally require higher yield and tensile strength than other areas of the cylinder head 10. For example, faster cooling rates of aluminum alloys produce finer microstructure; approximately 20 μm dendritic arm spacing (DAS). Other areas of the cylinder head 10 that cool at a slower rate may result in DAS of about 60 μm.

Figure 3:
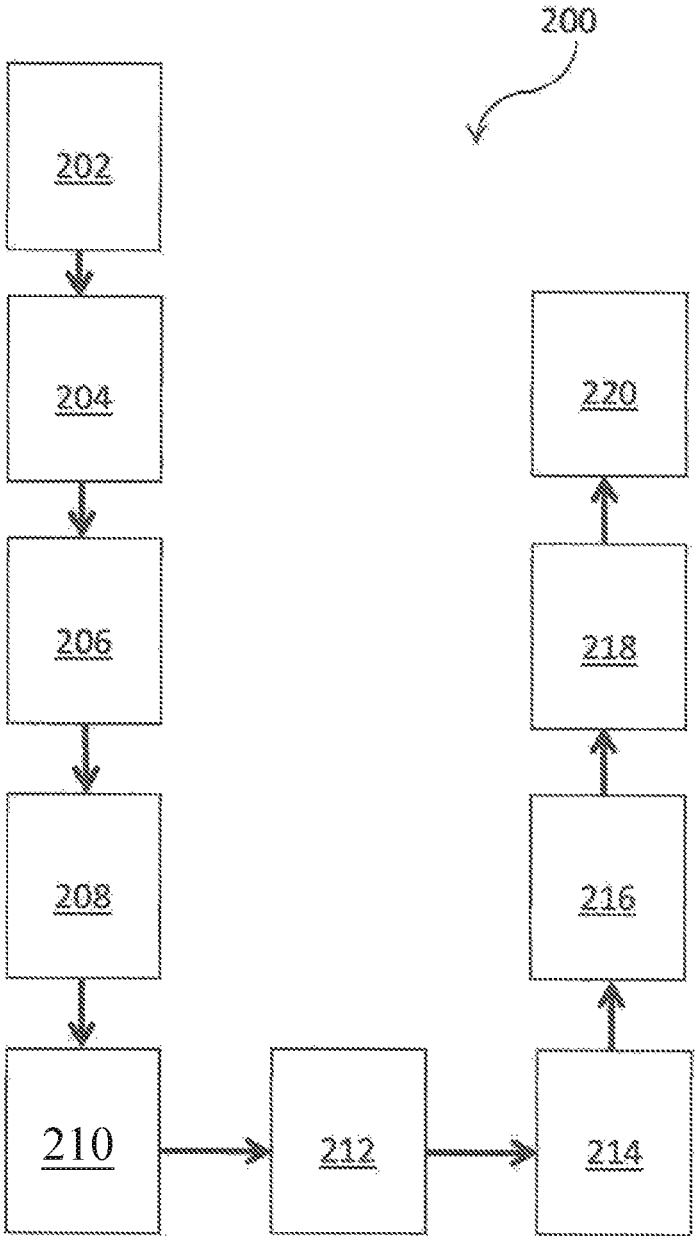
FIG. 3 is a flowchart depicting a method of casting a cylinder head according to the principles of the present disclosure.
Figure 4:
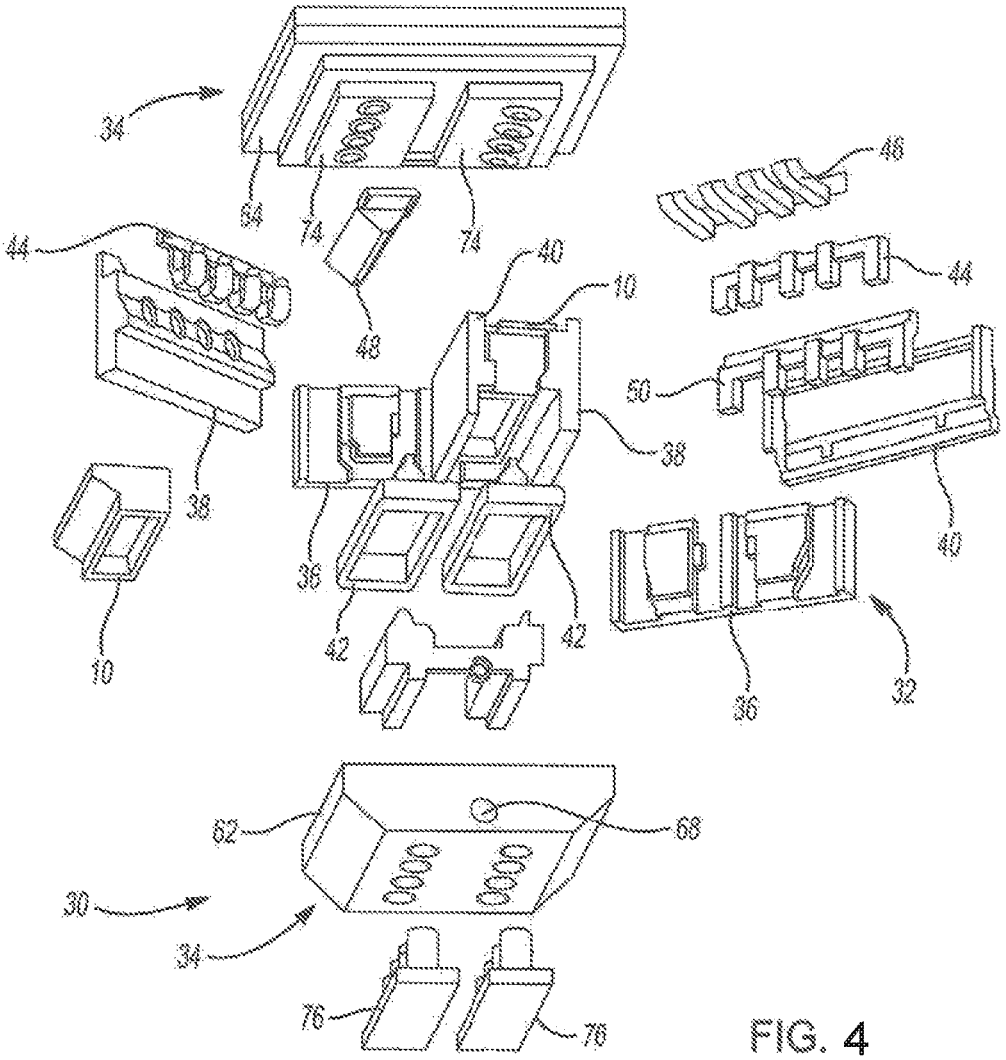
FIG. 4 is an exploded view of a precision sand core and mold assembly according to the principles of the present disclosure.
Figure 5:
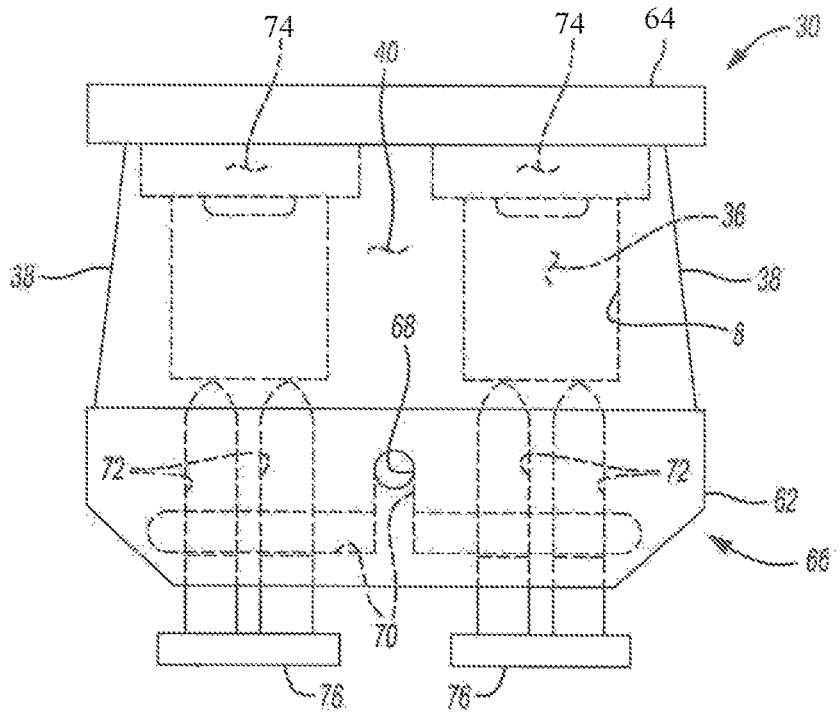
FIG. 5 is a side view of a precision sand core and mold assembly according to the principles of the present disclosure.
Figure 6:
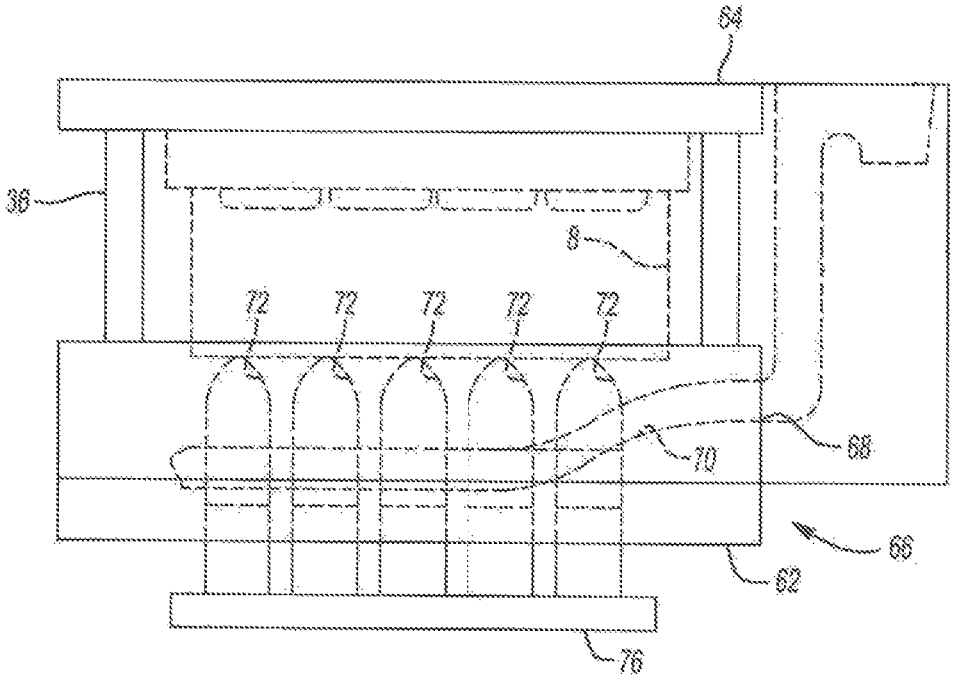
FIG. 6 is a side view of a precision sand core and mold assembly according to the principles of the present disclosure.

Turning now to FIG. 3, a flowchart illustrates in detail the PAPSC method 200 and steps which will now be described. While the method 200 as described is a casting method for making cylinder heads, the method 200 is also applicable to manufacturing other castings such as cylinder blocks, transmission housings, etc. without departing from the scope of the disclosure. A first step 202 of the method 200 includes providing a precision sand core and mold assembly 30, an example of which is shown in FIGS. 4-8.

Turning now to FIGS. 4-8, a mold assembly 30 used in the casting method 200 to produce cylinder heads 10 according to the present disclosure is illustrated and will now be described. The particular precision sand sore and mold assembly 30 of FIGS. 4-6 produces two cylinder head 10 castings in a mold cavity 8 formed by a number of sand cores 32 and sand molds 34. However, certain exterior features of the cylinder head 10 casting may be formed using sand or metal molds 34. For example, the molds 34 may be made from tool steel and fitted with hydraulic actuators to provide improved mechanical properties and reusable or permanent molds 34. Additionally, some of the interior sand cores 32 may not be made from sand. Alternatively, for example, some of the cores 32 may be formed with salt or other materials.

The sand cores 32 form part of the exterior features and all the interior features of the cylinder head 10 casting and include, for example, two end cores 36, two side cores 38, two center cores 40, two head cover cores 42, two exhaust port cores 44, two intake port cores 46, two water jacket cores 48, and two oil drain cores 50. The molds 34 include a lower or drag mold 62, an upper or cope mold 64, two head deck chills 74, and two piston cores 76. During assembly of the mold assembly 30, the sand cores 32 are inserted in a specified order into the drag mold 62 or the cope mold 64. In the example shown in FIGS. 4, 5, and 6, the sand cores 32 are placed in the drag mold 62 with the cope mold 64 placed on top of the assembled sand cores 32 thus securing the sand cores 32 in place. In some examples, the sand cores 32 are assembled into a core package prior to placing the core package into the drag mold 62. In other examples, the sand cores 32 may require adhesive, screws, and other retention mechanisms to hold the sand cores 32 in place. However, such practices are within the scope of the present disclosure. Details regarding the piston core 76 are explained in more detail below.

In the present disclosure, the included features of the drag mold 62 are of particular interest. The drag mold 62 includes a gating system 66 formed for receiving liquid metal from a pressurized liquid metal alloy source and quiescently directing the liquid metal alloy to the cavities formed therein by the sand cores 32 and sand molds 34 of the mold assembly 30. While a portion of the gating system 66 is viewable in FIG. 4, the gating system 66 is shown in more detail in FIGS. 5 and 6. The gating system 66 of the drag mold 62 includes an inlet 68, a plurality of runners 70, a gate shut-off core 71 and a plurality of riser cavities or risers 72. The gate shut-off core 71 closes the gating system 66 to prevent backflow of liquid aluminum when the piston core 76 is acting upon the risers 72.

Figure 8:
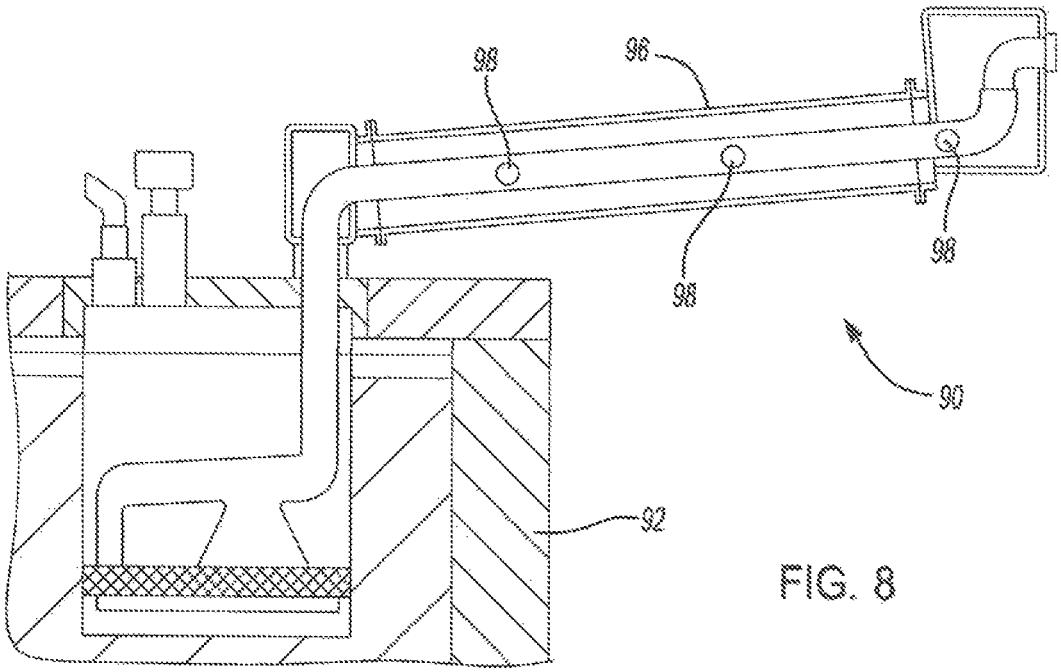
FIG. 8 is a side view of a metal casting furnace according to the principles of the present disclosure.
Figure 9:
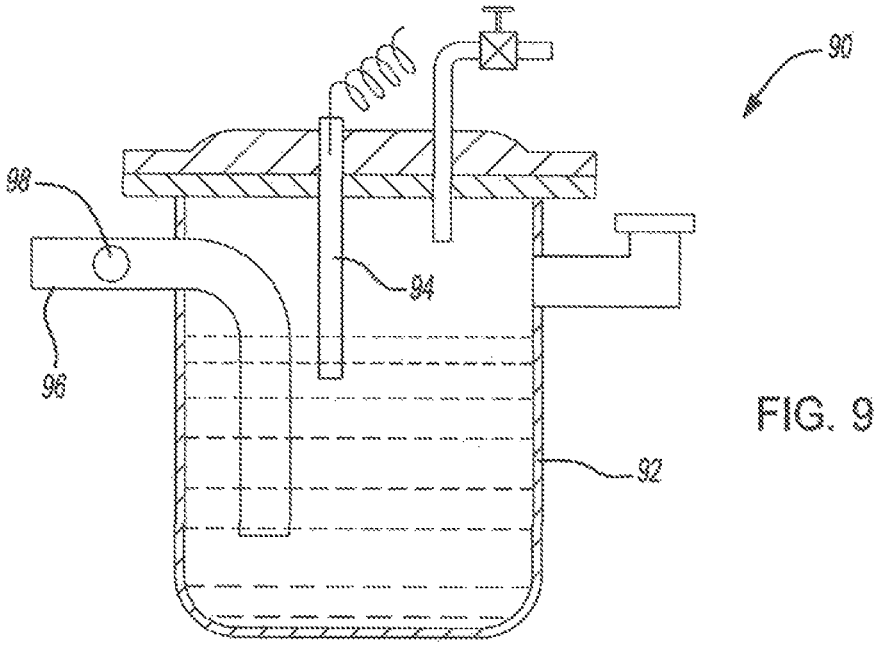
FIG. 9 is a side view of a metal casting furnace according to the principles of the present disclosure.
Figure 10:
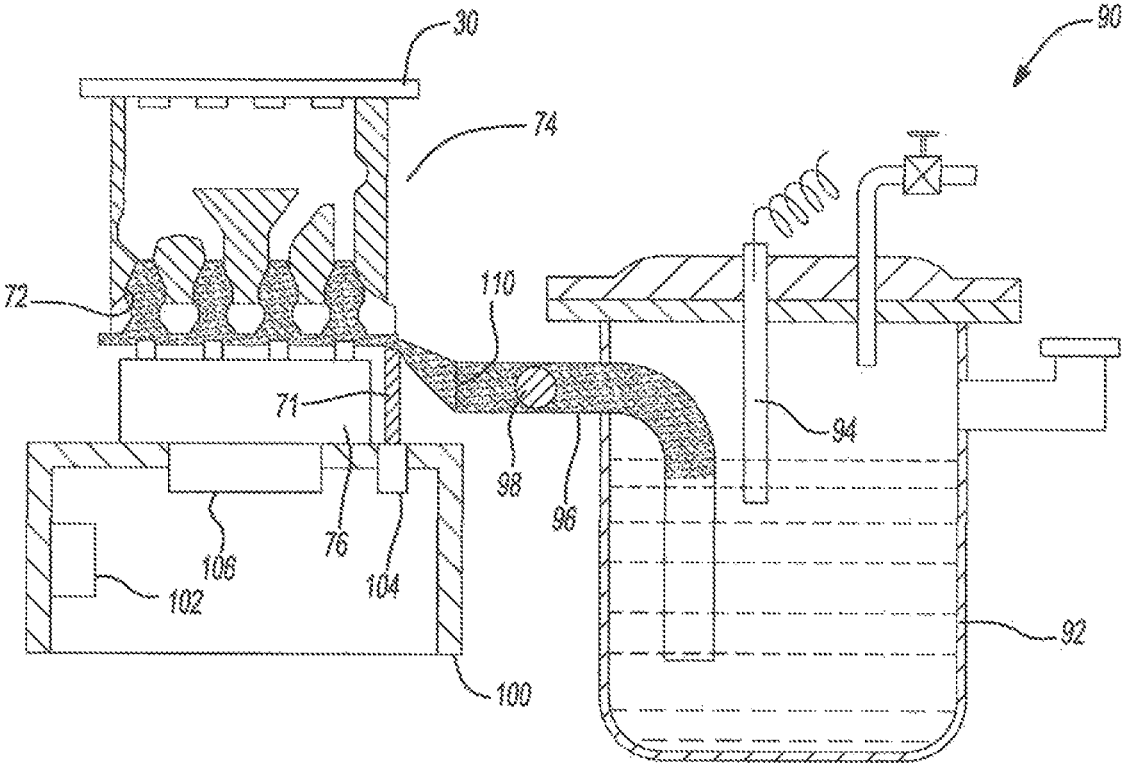
FIG. 10 is a side view of a metal casting furnace and a precision sand core and mold assembly according to the principles of the present disclosure.
Figure 11:
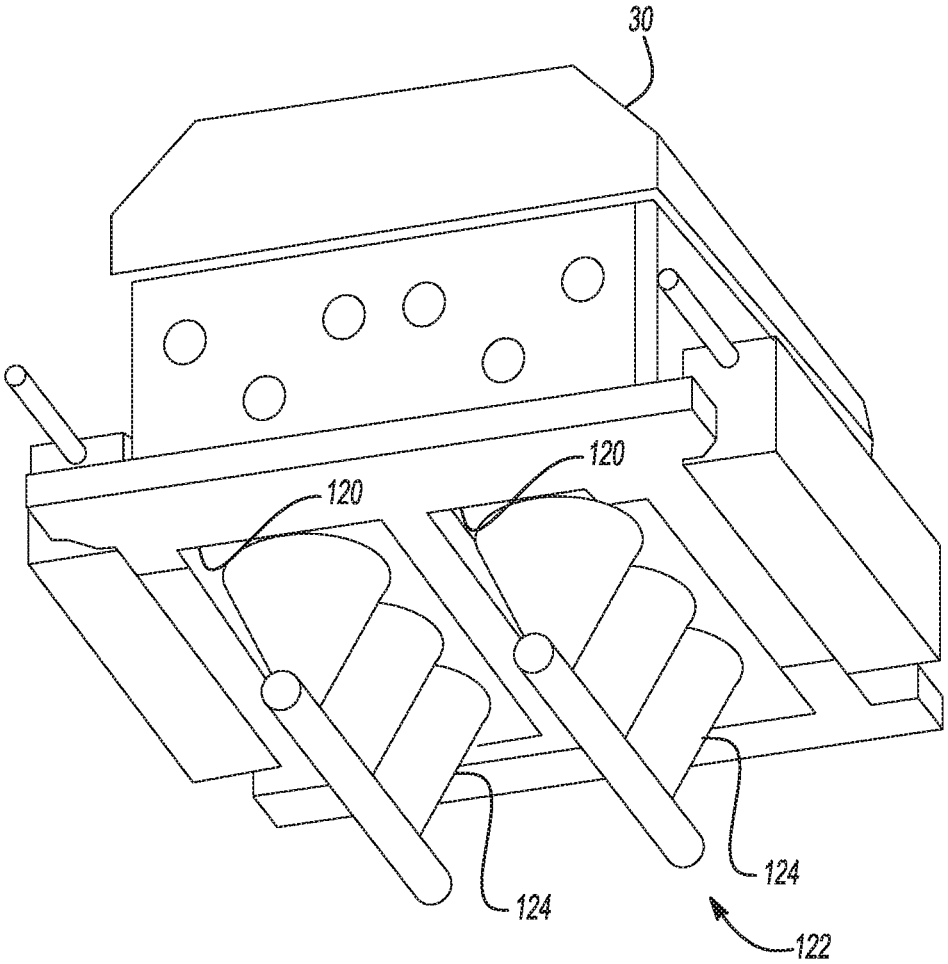
FIG. 11 is a perspective view of a precision sand core and mold assembly and a quench system according to the principles of the present disclosure.

Referring back to FIG. 3, a second step 204 of the method 200 includes providing an aluminum alloy delivery system or furnace 90; examples of which are shown in detail in FIGS. 8 and 9. The aluminum alloy delivery system includes a furnace 92, an in-furnace ultrasonic actuator 94, a launder tube 96, and an in-tube ultrasonic actuator 98. The ultrasonic actuators 94, 98 aid to help degas the liquid aluminum melt and improve grain refinement.

Figure 7:
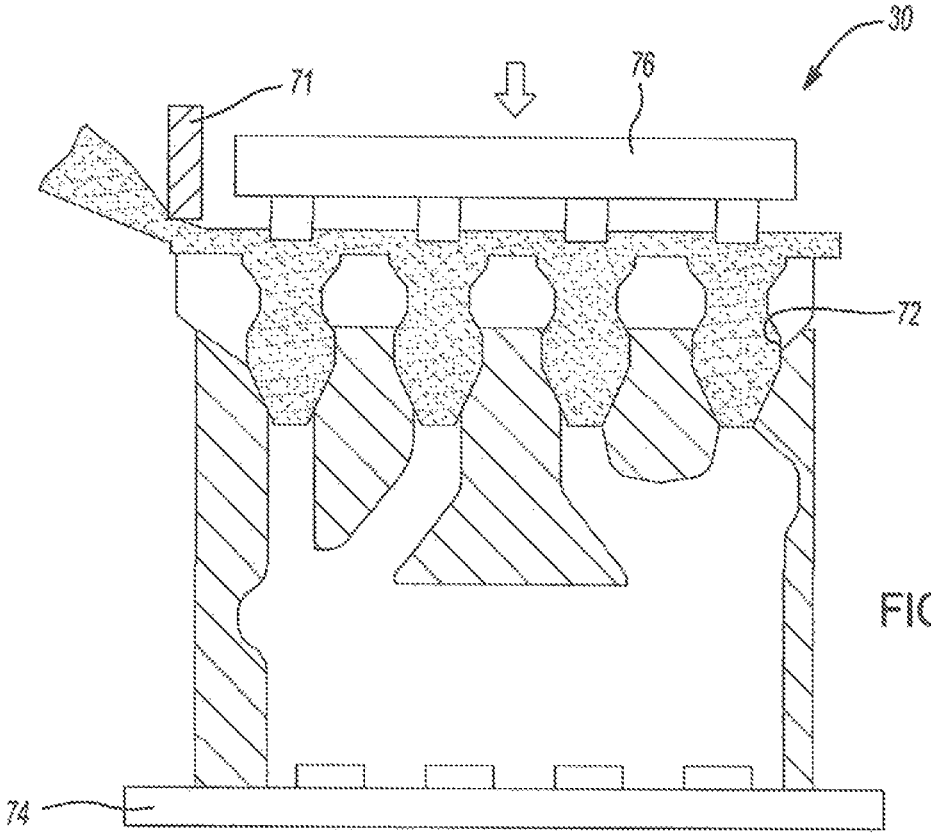
FIG. 7 a side view of a precision sand core and mold assembly according to the principles of the present disclosure.

A third step 206 of the method includes providing a mold manipulator 100 for holding and transferring the precision sand and mold assembly 30. The mold manipulator 100, as shown in FIG. 7, includes a vibration mechanism 102, a gate shut-off core actuator 104, and a piston core actuator 106. The gate shut-off core actuator 104 engages to move the gate shut-off core 71 of the precision sand core and mold assembly 30 to a position which prevents backflow of the liquid aluminum from the precision sand core and mold assembly 30. The piston core actuator 106 actuates to apply pressure to piston core 76 and the risers 72 as the casting is solidifying. Alternatively, the piston core actuator 106 releases the piston core 76 which is then allowed to apply pressure on the risers 72 due to gravity forcing the piston core 76 into the risers 72.

In a fourth step 208 of the method 200, the precision sand core and mold assembly 30 is sealed to a mouthpiece 110 of the launder tube 96 of the furnace 90. Liquid aluminum alloy is pumped or otherwise presented to the precision sand core and mold assembly 30 at low pressure. The furnace 90 can be a mechanical, an electromagnetic or a compressed gas furnace without departing from the scope of the disclosure. The precision sand core and mold assembly 30 is oriented with the risers 72 on the bottom of the precision sand core and mold assembly 30 and the head deck chills 74 on top.

The fifth step 210 of the method 200, activates the mold manipulator 100 to roll the precision sand core and mold assembly 30 placing the risers 72 on top of the precision sand core and mold assembly 30 and the head deck chills 74 on the bottom. Next, a sixth step 212 activates the vibration mechanism 102 on the mold manipulator 100. Vibrating the precision sand core and mold assembly 30 as it solidifies helps in degassing the liquid aluminum alloy and improve grain refinement. The seventh step 214 actuates the gate shut-off core actuator 104 to move the gate shut-off core 71 into position to stop the backflow of liquid aluminum out of the precision sand core and mold assembly 30.

Once the gate shut-off core 71 is in position, an eighth step 216 releases the piston core 76 to fall into the risers 72 or gating system 66 applying pressure to the liquid aluminum alloy in the gating system 66. The piston core actuator 106 may also apply a force to the piston core 76 into the risers 72.

The ninth step 218 removes the head deck chills 74 from the precision sand core and mold assembly 30 and is followed by a tenth step 220 of quenching the head deck 12 and combustion chambers 14 of the casting with a water spray or a force air. More particularly, the head deck chills 74 are removed from the drag mold 62 creating an access 120 to the solidified surface of the head deck 12 and combustion chambers 14. The head deck chills 74 are cooled, cleaned, and reinserted in a new precision sand core and mold assembly 30. The precision sand core and mold assembly 30 is positioned over a quench system 122 as shown in FIG. 9. The quench system 122 introduces a pressurized water spray 124 through the access 120 of the drag mold 62 to further chill the head deck 12 and combustion chambers 14 at an even higher cooling rate than provided by the head deck chills 74. The pressurized water spray 124 continues for a prescribed time. The quench system 122 may also include a forced air or water mist cooling system without departing from the scope of the present disclosure. The precision sand core and mold assembly 30 is then loaded onto a pallet or rack and loaded into an oven for sand removal and a first heat treatment.

While the best modes for carrying out the disclosure have been described in detail, those familiar with the art to which this disclosure relates will recognize various alternative designs and examples for practicing the disclosure within the scope of the appended claims.

The following is claimed:

1. A method of manufacturing an aluminum alloy cylinder head, the method comprising:

providing a precision sand core and mold assembly having a head deck face chill, a piston core, and a gate shut-off core, a liquid aluminum alloy delivery system, and a mold manipulator system, and wherein the precision sand core and mold assembly is disposed in the mold manipulator system;

sealing the liquid aluminum alloy delivery system to the precision sand core and mold assembly and providing liquid aluminum alloy into a gating system of the precision sand core and mold assembly;

rotating the precision sand core and mold assembly approximately 180°; and vibrating the precision sand core and mold assembly.

2. The method of claim 1 wherein providing a precision sand core and mold assembly, a liquid aluminum alloy delivery system, and a mold manipulator system, and wherein the precision sand core and mold assembly is disposed in the mold manipulator system further comprises providing the precision sand core and mold assembly, the liquid aluminum alloy delivery system having an in-furnace ultrasonic actuator and a launder tube having an ultrasonic actuator, and the mold manipulator system, and wherein the precision sand core and mold assembly is disposed in the mold manipulator system.

3. The method of claim 1 wherein providing a precision sand core and mold assembly having a head deck face chill, a piston core, and a pate shut-off core, a liquid aluminum alloy delivery system, and a mold manipulator system, and wherein the precision sand core and mold assembly is disposed in the mold manipulator system further comprises providing the precision sand core and mold assembly having a head deck face chill, a piston core, and a gate shut-off core, the liquid aluminum alloy delivery system, and the mold manipulator system having a vibration mechanism, a gate shut-off core actuator and a piston core actuator, and wherein the precision sand core and mold assembly is disposed in the mold manipulator system.

4. The method of claim 3 further comprising energizing the gate shut-off core actuator to insert the gate shut-off core into the gating system of the precision sand core and mold assembly sealing the gating system.

5. The method of claim 4 further comprising actuating the piston core actuator to release the piston core to fall into the gating system applying pressure to the liquid aluminum alloy in the gating system.

6. The method of claim 5 further comprising removing the head deck face chill from the precision sand core and mold assembly.

7. The method of claim 6 further comprising quenching a head deck face of the aluminum alloy cylinder head with one of a water spray and a forced air.

8. A method of manufacturing an aluminum alloy cylinder head, the method comprising:

providing a precision sand core and mold assembly having a head deck face chill, a piston core, and a gate shut-off core, a liquid aluminum alloy delivery system, and a mold manipulator system, and wherein the precision sand core and mold assembly is disposed in the mold manipulator system having a vibration mechanism, a gate shut-off core actuator and a piston core actuator and the liquid aluminum alloy delivery system includes an in-furnace ultrasonic actuator and a launder tube having at least an ultrasonic actuator;

sealing the liquid aluminum alloy delivery system to the precision sand core and mold assembly and providing liquid aluminum alloy into a gating system of the precision sand core and mold assembly;

rotating the precision sand core and mold assembly approximately 180°; and vibrating the precision sand core and mold assembly.

9. The method of claim 8 further comprising energizing the gate shut-off core actuator to insert the gate shut-off core into the gating system of the precision sand core and mold assembly sealing the gating system.

10. The method of claim 9 further comprising actuating the piston core actuator to release the piston core to fall into the gating system applying pressure to the liquid aluminum alloy in the gating system.

11. The method of claim 10 further comprising removing the head deck face chill from the precision sand core and mold assembly.

12. The method of claim 11 further comprising quenching a head deck face of the aluminum alloy cylinder head with one of a water spray and a forced air.

13. A method of manufacturing an aluminum alloy cylinder head, the method comprising:

providing a precision sand core and mold assembly, a liquid aluminum alloy delivery system, and a mold manipulator system, and wherein the precision sand core and mold assembly is disposed in the mold manipulator system, the precision sand core and mold assembly includes a head deck face chill, a piston core, and a gate shut-off core, the liquid aluminum alloy delivery system includes an in-furnace ultrasonic actuator and a launder tube having at least an ultrasonic actuator, and the mold manipulator system includes a vibration mechanism, a gate shut-off core actuator and a piston core actuator;

sealing the liquid aluminum alloy delivery system to the precision sand core and mold assembly and providing liquid aluminum alloy into a gating system of the precision sand core and mold assembly;

rotating the precision sand core and mold assembly approximately 180°;

vibrating the precision sand core and mold assembly;

energizing the gate shut-off core actuator to insert the gate shut-off core into the gating system of the precision sand core and mold assembly sealing the gating system; and actuating the piston core actuator to release the piston core to fall into the gating system applying pressure to the liquid aluminum alloy in the gating system.

14. The method of claim 13 further comprising removing the head deck face chill from the precision sand core and mold assembly.

15. The method of claim 14 further comprising quenching a head deck face of the aluminum alloy cylinder head with one of a water spray and a forced air.

* * * * *